US012180614B2

(12) United States Patent
Klepsch et al.

(10) Patent No.: US 12,180,614 B2
(45) Date of Patent: Dec. 31, 2024

(54) DEVICE FOR PRODUCING ELECTROSPUN SHORT POLYMER FIBRES

(71) Applicant: ITK—Innovative Technologies by Klepsch GmbH, Piesendorf (AT)

(72) Inventors: Wilhelm Klepsch, Kaprun (AT); Michael Berghold, Kaprun (AT); Björn Klepsch, Vienna (AT); Christian Eisenmann, Saalfelden (AT); Marco Grugger, Zell am Zee (AT)

(73) Assignee: ITK—Innovative Technologies by Klepsch GmbH, Piesendorf (AT)

( * ) Notice: Subject to any disclaimer, the term of this patent is extended or adjusted under 35 U.S.C. 154(b) by 440 days.

(21) Appl. No.: 17/772,617

(22) PCT Filed: Oct. 28, 2020

(86) PCT No.: PCT/AT2020/060382
§ 371 (c)(1),
(2) Date: Apr. 28, 2022

(87) PCT Pub. No.: WO2021/081573
PCT Pub. Date: May 6, 2021

(65) Prior Publication Data

US 2022/0372660 A1 Nov. 24, 2022

(30) Foreign Application Priority Data

Oct. 28, 2019 (AT) ..... A 50926/2019

(51) Int. Cl.
*D01D 5/00* (2006.01)
*D01D 5/26* (2006.01)

(52) U.S. Cl.
CPC ..... *D01D 5/26* (2013.01); *D01D 5/0061* (2013.01); *D01D 5/0076* (2013.01)

(58) Field of Classification Search
CPC .. D01D 5/0007; D01D 5/0046; D01D 5/0061; D01D 5/0076; D01D 5/0092
See application file for complete search history.

(56) References Cited

U.S. PATENT DOCUMENTS 2,683,073 A * 7/1954 Pierce ..... D01D 1/04 425/382.2
5,585,052 A 12/1996 Chau et al.
(Continued)

FOREIGN PATENT DOCUMENTS

CN 109306528 A 2/2019
JP 2012052271 A 3/2012
(Continued)

OTHER PUBLICATIONS

English language abstract for CN109306528 A, Feb. 5, 2019.
English language abstract for JP2012052271 A, Mar. 15, 2012.

*Primary Examiner* — Thu Khanh T. Nguyen
(74) *Attorney, Agent, or Firm* — Tiajoloff & Kelly LLP

(57) ABSTRACT

A device for producing electrospun polymer short fibers has a dosing electrode (1) and a collector medium (3) opposite the dosing electrode (1) in the dosing direction (2). In order to create a device that enables continuous production of electrospun polymer short fibers, a cutting grid (5), which can be heated at least to the softening temperature of the polymer and which has a mesh size that corresponds to the minimum fiber length, is arranged upstream of the collector medium (3) in the dosing direction (2).

18 Claims, 1 Drawing Sheet

(56) References Cited

U.S. PATENT DOCUMENTS

| | | | | |
|---|---|---|---|---|
| 2008/0296808 | A1* | 12/2008 | Joo | D01F 2/02 425/71 |
| 2011/0180951 | A1* | 7/2011 | Teo | D01D 5/0046 264/109 |
| 2018/0030623 | A1 | 2/2018 | Greiner et al. | |
| 2020/0377837 | A1* | 12/2020 | Cornu | D01D 5/0038 |
| 2021/0043905 | A1* | 2/2021 | Kishi | D01D 5/0084 |

FOREIGN PATENT DOCUMENTS

| | | | |
|---|---|---|---|
| WO | 96/05340 | A1 | 2/1996 |
| WO | 2006/089529 | A1 | 8/2006 |
| WO | 2016/128195 | A1 | 8/2016 |

* cited by examiner

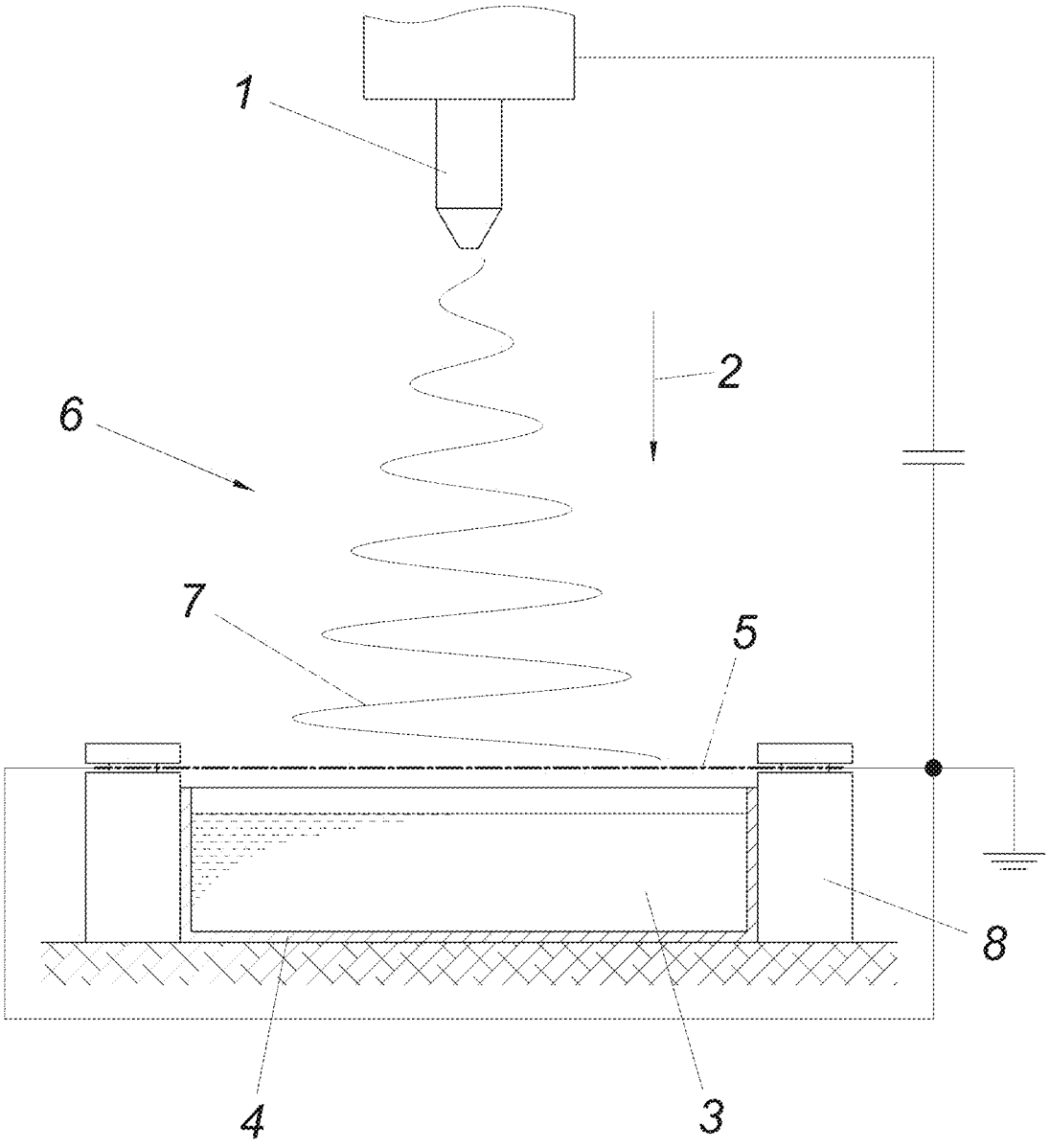
1
2
6
7
5
8
4
3

DEVICE FOR PRODUCING ELECTROSPUN SHORT POLYMER FIBRES

FIELD OF THE INVENTION

The invention relates to a device for producing electrospun polymer short fibers, comprising a dosing electrode and a collector medium opposite the dosing electrode in the dosing direction.

DESCRIPTION OF THE PRIOR ART

So-called electrospinning devices are known for the production of thermoplastic polymer fibers, which have a dosing electrode for dispensing a polymer solution or a polymer melt and a collector plate opposite the dosing electrode in the dosing direction. An electric field is applied in a take-off region extending between the dosing electrode and the collector plate, which is acting as a counter-electrode, whereby the polymeric solution or melt droplets are electrostatically charged at the dosing electrode and stretched under the influence of the electric field until a thin jet develops in the dosing direction towards the collector plate. Evaporation of the solvent or solidification of the melt produces polymer fibers which are deposited on the collector plate.

In order to subsequently obtain short fibers in a storable form, the previously electrospun polymer fibers can first be added to a storage liquid based on an ethanol/water mixture, which is cooled together with the polymer fibers below the glass transition temperature of the polymer fibers, as described for example in WO 2016128195 A1. With the aid of a mixer, the polymer fibers, which are brittle due to the temperature, are then reduced to short fibers and dispersed in the storage liquid.

A disadvantage, however, is that the production of electrospun polymer short fibers has so far only been possible in a time-consuming, discontinuous process, because a primary fiber ball or primary fiber nonwoven must first be spun, which can only be further processed into short fibers in a separate process step.

SUMMARY OF THE INVENTION

The invention is thus based on the object of creating a device of the type described at the beginning, which enables continuous production of electrospun polymer short fibers.

The invention solves the problem in that a cutting grid, which can be heated at least to the softening temperature of the polymer and which mesh size corresponds to the minimum fiber length, is arranged upstream of the collector medium in the dosing direction.

As a result of these features, short fibers can be continuously produced within one process step because a primary fiber developing in the take-off region extending between the dosing electrode and the collector medium first encounters the heatable cutting grid and, as it passes through the latter, is cut into short fibers which are subsequently deposited on the collector medium. Due to electrostatically induced bending instabilities, the primary fiber essentially describes a path curve in the take-off region, which path curve has a cone extending in the dosing direction as its envelope. Consequently, the primary fiber generally strikes the cutting grid at an acute angle of incidence relative to the cutting grid plane such that the border sections enclosing the individual grid openings or grid meshes in each case form corresponding cutting edges for the incident primary fiber.

Since the primary fiber is also heated locally at or above the softening temperature of the polymer at a fiber cutting section in contact with the respective grid mesh, the primary fiber can thus be broken up easily at the grid meshes. The resulting short fibers are subsequently deposited on the collector medium. In this case, the collector medium can also be a liquid, for example, which forms the reference potential or the counter-electrode to the dosing electrode by means of grounding. The liquid can be an appropriate storage liquid, for example an ethanol/water mixture, so that the short fibers can be deposited directly in it and dispersed therein. In order to obtain storable short fiber dispersions in a continuous process, which can be further processed without difficulty in subsequent steps, the collector vessel comprising the storage liquid can comprise a liquid outlet via which the storage liquid together with the short fibers dispersed therein can be conveyed, for example, to a filling device. Although the provision of a heating element basically leads to air mass heating and movement in the take-off area due to the formation of convection currents, which in turn can result in impairment of the trajectory of the primary fiber or premature solidification of the polymer at the dosing electrode, it has been shown that heating the cutting grid to a temperature in a range of +−20% of the softening temperature, preferably to the softening temperature of the polymer, does not impair the manufacturing process. The softening temperature is understood to be in particular the melting temperature in the case of semi-crystalline polymers or the glass transition temperature in the case of amorphous polymers.

In order to increase the frequency of the generated short fibers according to a probability density function relating to the fiber length distribution with simple design measures, it is proposed that the cutting grid has a mesh size of at least 5 μm. It has been shown that the fiber length distribution of the generated short fibers can be influenced by changing the mesh size of the cutting grid, although below a mesh size of 5 μm the primary fiber is no longer cut, but is deposited on the cutting grid due to the increased specific surface area of the cutting grid and optionally evaporates before any short fibers can land on the collector medium. Although the angle of impact of the primary fiber on the grid meshes fundamentally influences the short fiber length, for a given mesh size x, the frequency of short fibers with fiber lengths l in a range $x \leq l \leq x*\sqrt{2}$ can be increased in particular, wherein the mesh size x is at least 5 μm. Since only the projection of the mesh size on the normal plane to the dosing direction is decisive for the cutting process, the fiber length distribution can also be controlled within certain limits with the aid of a cutting grid with a predetermined mesh size by inclining the cutting grid out of that normal plane.

In order to achieve particularly favorable process conditions when a storage liquid is used as the collector medium, it is recommended that the cutting grid is designed as an electrical heating resistor and as a counter-electrode to the dosing electrode. As a result of these measures, an electric field is built up between the cutting grid and the dosing electrode. A heating current flows through the cutting grid between two connection poles. This heating current is generated by two different electrical potentials applied to the cutting grid, which differ substantially from that of the dosing electrode, so that the heating currents do not influence the electrospinning process. For example, the cutting grid can be grounded with a terminal pole. Since the electrical charges of the short fibers are already neutralized for the most part at the cutting grid, the short fibers produced can be deposited on or introduced into the collector medium without being hindered by electrical forces. Particularly when a storage liquid is used as the collector medium, the method can thus be carried out independently of its electrical conductivity and without the collector medium itself having to act as a counter-electrode.

The stability and continuity of the manufacturing process can be further improved, particularly when polymers with high melting temperatures are used, if a take-off region extending between the dosing electrode and the cutting grid can be cooled by a temperature control fluid. This makes it possible, for example, to counteract undesirable heating of the air in the take-off region due to the heated cutting grid, which would impair the trajectory of the primary fiber, and thus to achieve a more stable production process. For example, the take-off region can be appropriately tempered by supplying cooled air, wherein the flow rate is to be selected in such a way that the stretching of the primary fiber is not impaired. In the case where polymer solutions are used, the process conditions can be further improved if the dosing electrode itself is cooled via a heat-transfer fluid, for example by a cooling air stream flowing around it. This can prevent the solvent from evaporating prematurely and the released polymer from clogging the dosing electrode.

The invention also relates to a method for producing polymer short fibers using a device according to the invention. In this process, an electric field is first generated between a dosing electrode for dispensing a polymer system and a collector medium for depositing the spun fibers. In response to the electric field, a primary fiber is withdrawn from the dosing electrode. In this context, a polymer system is understood to mean the polymeric starting material for producing the fibers, i.e. in particular water-soluble, solvent-based as well as meltable polymers together with any additives and fillers. The primary fiber is heated in sections at least to the softening temperature of the polymer and thereby cut into short fibers, after which the short fibers are deposited on the collector medium. Particularly favorable conditions result when the short fibers are deposited on a storage fluid, for example a liquid ethanol/water mixture, as collector medium and dispersed therein. The storable short fiber dispersion obtained in this way can then be further processed without difficulty, for example for the production of filter materials.

BRIEF DESCRIPTION OF THE INVENTION

In the drawing, the subject matter of the invention is shown, for example, in a schematic representation of a device according to the invention.

DETAILED DESCRIPTION OF THE PREFERRED EMBODIMENTS

A device according to the invention comprises a dosing electrode 1 and a collector medium 3 opposite the dosing electrode 1 in dosing direction 2. The collector medium can be a storage liquid for the short fibers produced, for example an ethanol/water mixture located in a collector vessel 4. A cutting grid 5 heated at least to the softening temperature of the polymer is arranged upstream of the collector medium 3 in the dosing direction 2, the mesh size of which corresponds to the minimum fiber length of the short fibers produced.

For the production of electrospun polymer short fibers, various polymer systems can be used as starting materials, in particular water-soluble, solvent-based and meltable polymers together with any additives and fillers. For example, to obtain fibers based on polymethyl methacrylate, the starting material can be a polymer solution comprising mass fractions of about 20% of polymethyl methacrylate, about 55% of acetic acid, and about 25% of ethyl acetate, plus any additional additives. The softening temperature, in the case of the amorphous polymethyl methacrylate, would be its glass transition temperature, which is about 100°–110° C.

A voltage, which can be between 20 kV and 30 kV, is applied between the dosing electrode 1 and the heated cutting grid 5 and/or the collector medium 3 to generate an electric field. The polymer solution is fed at a flow rate of 3 ml/hour to 9 ml/hour via the dosing electrode 1 to the take-off region 6, whereby the polymer droplet forming at the dosing electrode 1 is electrostatically charged and stretched under the influence of the electric field. This results in the development of a primary fiber 7 which, due to electrostatically induced bending instabilities, essentially describes a path curve in the take-off region 6 which has a cone extending in the dosing direction 2 as its envelope, as indicated schematically in the drawing.

The primary fiber 7 is heated by the cutting grid 5 in sections at least to the softening temperature of the polymer and thereby cut into short fibers, in that the primary fiber 7 strikes the cutting grid 5 at an acute angle of incidence relative to the cutting grid plane in such a way that the border sections enclosing the individual grid openings or grid meshes form corresponding cutting edges for the incident primary fiber 7. The short fibers produced in this way, which are not shown in detail in the drawing, are subsequently deposited on the collector medium 3 and dispersed therein, so that the short fiber dispersion thus obtained can be further processed without difficulty, for example as a spray base for the production of filter materials. For this purpose, the collector vessel 4 can have a corresponding liquid outlet via which the storage liquid together with the short fibers dispersed therein can be passed on to a filling device.

The fiber length distribution can be influenced, for example, by the mesh size of the grid meshes of the cutting grid 5. In order to increase the frequency of the generated short fibers according to a probability density function related to the fiber length distribution, the cutting grid 5 can have a mesh size of at least 5 μm.

Favorable process conditions are obtained if the cutting grid 5 is designed as an electrical heating resistor and as a counter-electrode to the dosing electrode 1. A heating current generated by two different electrical potentials applied to the cutting grid 5 flows through the cutting grid 5 between two connection poles of a supply unit 8.

According to some embodiments, the dosing electrode 1 and/or the take-off region 6 extending between the dosing electrode 1 and the cutting grid 5 can be cooled via a heat-transfer fluid. This can counteract undesirable heating of the air in the take-off region 6 due to the heated cutting grid 5, which impairs the trajectory of the primary fiber 7, as well as clogging of the dosing electrode 1, whereby a more stable manufacturing process can be achieved.

The invention claimed is:

1. A device for producing electrospun polymer short fibers, said device comprising:

a dosing electrode having a dosing direction; and a collector medium opposite the dosing electrode in the dosing direction; and a cutting grid that is heated at least to a softening temperature of a polymer of which the polymer short fibers are comprised, and that has a mesh size that corresponds to a minimum fiber length, is arranged upstream of the collector medium in the dosing direction.

2. The device according to claim 1, wherein the mesh size of the cutting grid is at least 5 μm.

3. The device according to claim 1, wherein the cutting grid is comprises an electrical heating resistor and operates as a counter-electrode to the dosing electrode.

4. The device according to claim 1, wherein the dosing electrode and/or a take-off region extending between the dosing electrode and the cutting grid is cooled by a heat-transfer fluid.

5. A method for producing electrospun polymer short fibers, said method comprising:

providing a device according to claim 1;

generating an electric field between the dosing electrode and the collector medium on which the spun polymer short fibers are deposited;

first drawing off, as a result of the electric field, a primary fiber from the dosing electrode and cutting a primary fiber into the short fibers by heating thereof in sections at least to the softening temperature of the polymer, and then depositing the short fibers on the collector medium.

6. The method according to claim 5, wherein the collector medium includes a storage fluid, and the short fibers are deposited on the storage fluid and dispersed therein.

7. The method according to claim 5, wherein the mesh size of the cutting grid is at least 5 μm.

8. The method according to claim 7, wherein the cutting grid comprises an electrical heating resistor, and the method further comprises operating the cutting grid as a counter-electrode to the dosing electrode.

9. The method according to claim 8, wherein the method further comprises cooling the dosing electrode and/or a take-off region extending between the dosing electrode and the cutting grid by a heat-transfer fluid.

10. The method according to claim 5, wherein the cutting grid comprises an electrical heating resistor, and the method further comprises operating the cutting grid as a counter-electrode to the dosing electrode.

11. The method according to claim 10, wherein the method further comprises cooling the dosing electrode and/or a take-off region extending between the dosing electrode and the cutting grid by a heat-transfer fluid.

12. The method according to claim 5, wherein the method further comprises cooling the dosing electrode and/or a take-off region extending between the dosing electrode and the cutting grid by a heat-transfer fluid.

13. The method according to claim 6, wherein the cutting grid comprises an electrical heating resistor, and the method further comprises operating the cutting grid as a counter-electrode to the dosing electrode.

14. The method according to claim 13, wherein the method further comprises cooling the dosing electrode and/or a take-off region extending between the dosing electrode and the cutting grid by a heat-transfer fluid.

15. The device according to claim 2, wherein the cutting grid comprises an electrical heating resistor and operates as a counter-electrode to the dosing electrode.

16. The device according to claim 2, wherein the dosing electrode and/or a take-off region extending between the dosing electrode and the cutting grid is cooled by a heat-transfer fluid.

17. The device according to claim 3, wherein the dosing electrode and/or a take-off region extending between the dosing electrode and the cutting grid is cooled by a heat-transfer fluid.

18. The device according to claim 13, wherein the dosing electrode and/or a take-off region extending between the dosing electrode and the cutting grid is cooled by a heat-transfer fluid.

* * * * *